US007533974B2

(12) United States Patent
Ohnishi et al.

(10) Patent No.: US 7,533,974 B2
(45) Date of Patent: May 19, 2009

(54) INK SUPPLY MECHANISM FOR INK JET PRINTERS

(75) Inventors: Masaru Ohnishi, Kawanishi (JP); Hitoshi Sato, Ueda (JP)

(73) Assignee: Mimaki Engineering Co., Ltd., Nagano (JP)

( * ) Notice: Subject to any disclaimer, the term of this patent is extended or adjusted under 35 U.S.C. 154(b) by 237 days.

(21) Appl. No.: 10/548,335

(22) PCT Filed: Dec. 26, 2003

(86) PCT No.: PCT/JP03/16911

§ 371 (c)(1),
(2), (4) Date: Aug. 31, 2006

(87) PCT Pub. No.: WO2004/067281

PCT Pub. Date: Aug. 12, 2004

(65) Prior Publication Data

US 2007/0076063 A1 Apr. 5, 2007

(30) Foreign Application Priority Data

Jan. 31, 2003 (JP) ..... 2003-025193

(51) Int. Cl.
*B41J 2/175* (2006.01)
*B41J 29/393* (2006.01)
*B41J 2/165* (2006.01)

(52) U.S. Cl. ..... 347/85; 347/19; 347/22

(58) Field of Classification Search ..... 347/5, 347/7, 21, 22, 49, 85, 86, 19

See application file for complete search history.

(56) References Cited

U.S. PATENT DOCUMENTS

| | | | | | |
|---|---|---|---|---|---|
| 4,320,406 | A | * | 3/1982 | Heinzl | 347/43 |
| 4,437,104 | A | * | 3/1984 | Hudson | 347/86 |
| 4,447,820 | A | * | 5/1984 | Terasawa | 347/86 |
| 4,636,814 | A | * | 1/1987 | Terasawa | 347/86 |
| 4,695,851 | A | * | 9/1987 | Terasawa | 347/30 |
| 4,965,596 | A | * | 10/1990 | Nagoshi et al. | 347/36 |
| 5,523,780 | A | * | 6/1996 | Hirosawa et al. | 347/86 |
| 6,206,511 | B1 | * | 3/2001 | Cook et al. | 347/85 |
| 6,234,603 | B1 | * | 5/2001 | Altfather et al. | 347/19 |

(Continued)

FOREIGN PATENT DOCUMENTS

JP 07-137275 5/1995

(Continued)

*Primary Examiner*—Anh T. N. Vo
(74) *Attorney, Agent, or Firm*—Ditthavong Mori & Steiner, P.C.

(57) ABSTRACT

A cartridge extension (80) having a plurality of cartridges (60) replaceably fitted therein is connected through an ink flow channel (90) to an ink supply port (50) formed in a printer main body (40). And ink is continuously supplied from one of the plurality of cartridges (60) fitted in the cartridge extension (80) to the ink supply port (50) through the ink flow channel (90), until the ink in the one cartridge (60) is depleted, whereupon the depletion is detected and the ink in the next cartridge (60) fitted in the cartridge extension (80) is continuously supplied to the ink supply port (50) through the ink flow channel (90). This step is repetitively performed by a sequence control means (100). And ink continuously supplied to the ink supply port (50) for a long period of time.

14 Claims, 5 Drawing Sheets

U.S. PATENT DOCUMENTS 6,866,372 B2 * 3/2005 Oda et al. ..... 347/85
7,168,798 B2 * 1/2007 Samii et al. ..... 347/86

FOREIGN PATENT DOCUMENTS

JP 10-329338 12/1998
JP 2001-219574 8/2001
JP 2001-225478 8/2001
JP 2002-052731 2/2002
JP 2002-178498 6/2002

* cited by examiner

INK SUPPLY MECHANISM FOR INK JET PRINTERS

TECHNICAL FIELD

The present invention relates to an ink supply mechanism for an ink jet printer, for supplying ink continuously without any interruption to an ink jet head for a long time.

BACKGROUND ART

As shown in FIG. 5, there is well known in the art the ink jet printer which prints patterns and/or letters composed of arrays of ink dots on the surface of a media (or a recording media) 30 such as a sheet placed on a platen 20 by moving an ink jet head 10 over the media 30 transversely (or longitudinally of the drawing) or longitudinally (or vertically of the drawing) with respect to the media 30, or by injecting ink droplets from nozzles 12 arranged on the lower face of the ink jet toward the surface of the media 30.

In a configuration of this printer, as shown in FIG. 5, an ink supplying cartridge 60 is replaceably fitted in an ink supply port 50 belonging to a printer body 40, so that the ink of the cartridge is supplied from the ink supply port 50 to the ink jet head 10 through the inside of a flexible long resin tube 52 or the like. The ink thus supplied to the ink jet head 10 is injected from the nozzles 12 arrayed on the lower face of said ink jet head to the surface of the media 30 placed on the platen 20.

In FIG. 5, the ink supply port 50 is spaced from the printer body 40 and drawn in an enlarged scale so as to clarify its configuration.

The ink jet printer thus configured is excellent in the handling property of its ink supply mechanism, in that the cartridge 60 fitted in the ink supply port 50 is replaced, when its ink is depleted, by another new cartridge 60 so that the ink charged into the new cartridge 60 can be easily supplied again to the ink jet head 10.

In case, however, the ink jet printer thus configured is continuously run day and night for a long time, the ink of the cartridge 60 fitted in the ink supply port 50 of the printer body may be depleted at night when the printer is unmanned without the monitoring eyes of the user. In other situations, the printer either stops without the depleted cartridge 60 being replaced by another new cartridge 60 or continues the so-called "idle run", in which the patterns or the letters are not printed on the media although the printer is acting.

In order to prevent this idle run or stop of the printer at night due to the ink depletion of the cartridge 60, there is a method for replacing the cartridge 60 fitted in the ink supply port 50 of the printer body and supplying the ink, in advance before the unmanned night by another new cartridge 60 filled up with the ink.

In this case, however, the cartridge 60 having been fitted in the ink supply port 50 of the printer body and supplying the ink is replaced before the unmanned night, although the ink is still left in a considerable amount, by the new cartridge 60. Moreover, the cartridge 60 containing the ink of a considerable amount is uselessly discarded.

The present invention has an object to provide such an ink supply mechanism for an ink jet printer (as will be called the "ink supply mechanism") as can solve that problem.

DISCLOSURE OF THE INVENTION

In order to achieve the aforementioned object, the first ink supply mechanism of the invention is configured such that the cartridge extension for fitting the ink supplying cartridges replaceably therein is connected through the ink flow channel to the ink supply port disposed in the printer body for supplying the ink to the ink jet head. Moreover, the ink of each of the cartridges fitted in the cartridge extension is supplied through the ink passage to the ink supply port of the printer body.

Moreover, the first ink supply mechanism is equipped with sequence control means for repeating such a step sequentially for the individual cartridges fitted in the cartridge extension as supplies the ink continuously from any of the cartridges fitted in the cartridge extension continuously to the ink supply port through the ink flow channel, and as detects that the ink in one cartridge is depleted, and as supplies the ink in the next cartridge fitted in the cartridge extension continuously to the ink supply port through the ink flow channel.

In order to achieve the aforementioned object, moreover, the second ink supply mechanism is equipped with a dummy cartridge to be fitted replaceably with the ink supplying cartridge in the ink supply port disposed in the printer body for supplying the ink to the ink jet head, and a cartridge extension for fitting a plurality of ink supplying cartridges replaceably.

The dummy cartridge and the cartridge extension are connected to each other through the ink flow channel. Moreover, the ink of each of the cartridges fitted in the cartridge extension is supplied to the ink supply port of the printer body through the ink passage and through the dummy cartridge fitted in the ink supply port.

Moreover, the second ink supply mechanism is equipped with sequence control means for repeating such a step sequentially for the individual cartridges fitted in the cartridge extension as supplies the ink continuously from any of the cartridges fitted in the cartridge extension continuously to the ink supply port through the ink flow channel and through the dummy cartridge fitted in the ink supply port, and as detects that the ink in one cartridge is depleted, and as supplies the ink in the next cartridge fitted in the cartridge extension continuously to the ink supply port through the ink flow channel and through the dummy cartridge fitted in the ink supply port.

In the first and second ink supply mechanisms thus configured, the ink from any of the cartridges fitted in the cartridge extension can be continuously supplied to the ink supply port of the printer body through the ink flow channel in the case of the first ink supply mechanism and through the ink flow channel and the dummy cartridge fitted in the ink supply port in the case of the second ink supply mechanism.

Moreover, the ink from any of the cartridges fitted in the cartridge extension is continuously supplied to the ink supply port of the printer body at the unmanned night while the printer is being continuously employed. When the residue of the ink in one cartridge is depleted, it can be detected by the sequence control means that the ink of one cartridge has been depleted. Moreover, the step, in which the cartridge depleted of the ink is replaced by the ink of another new cartridge fitted in the same cartridge extension and the ink is continuously supplied to the ink supply port of the printer body through the ink flow channel in the case of the first ink supply mechanism and through the ink flow channel and the dummy cartridge fitted in the ink supply port in the case of the second ink supply mechanism, can be performed by the sequence control means.

For the individual cartridges fitted in the cartridge extension, the same step as the aforementioned one can be sequentially repeated by the sequence control means each time one ink supplying cartridge is depleted of the ink. Moreover, it is possible to avoid the situations in which the ink depletion of the cartridge might occur at the unmanned night while the printer is being employed, causing to stop or idly run the ink jet printer.

Moreover, the cartridge fitted in the cartridge extension and depleted of ink can be replaced by another new cartridge filled with sufficient ink, in the state not interrupting but continuing the printing operation by the ink jet printer, while the ink supply port of the printer body is being supplied with the ink of the other cartridge fitted in the same cartridge extension. When another chance for supplying the ink of the new cartridge to the ink supply port comes, the sequence control means can be used like before to supply the ink of the new cartridge continuously to the ink supply port of the printer body.

On either the individual cartridges fitted in the cartridge extension or any of the newly fitted cartridge in the cartridge extension, the same step as the aforementioned one can be sequentially repeated by using the sequence control means. Moreover, the ink supply port of the printer body can be supplied with the ink continuously without any depletion for a long time.

Moreover, these first and second ink supply mechanisms are configured, as described above, such that the sequence control means detects that the ink of one of the cartridges individually fitted in the cartridge extension and supplying the ink to the ink supply port to the printer body is depleted, and after the ink being supplied from one of the cartridges was exploited without any waste, in place of the cartridge depleted of the ink, the ink of the new cartridge fitted in the cartridge extension is continuously supplied by the sequence control means to the ink supply port of the printer body. Therefore, the ink contained in the cartridges individually fitted in the cartridge extension is sequentially used up completely. Moreover, the individual cartridges fitted in the cartridge extension can be prevented from being wastefully discarded with the ink being not used up completely but left in a considerable amount.

Moreover, the second ink supply mechanism can be optionally employed without any change in the configuration of the general ink jet printer, in which an ink supplying cartridge is replaceably fitted in the ink supply port of the printer body so that the ink of the cartridge is supplied to the ink jet head. In other words, the printer can be equipped with the second ink supply mechanism merely by replacing the ink supplying cartridge in the ink supply port of the printer body by a dummy cartridge.

In the first and second ink supply mechanisms of the invention, warning means may be provided for notifying a printer user of it with light, sound or vibration means that the ink in the cartridge fitted in the cartridge extension and supplying the ink is depleted, when said sequence control means detects the depletion of the ink.

In this case, the warning means can notify the printer user of it reliably without any oversight of the printer user that the cartridge fitted in the cartridge extension and supplying the ink is depleted of the ink. Then, the printer user can replace the cartridge depleted of the ink, without any delay at all times by another new cartridge filled with the ink.

In the first and second ink supply mechanisms of the invention, said cartridge extension may be equipped with an insertion portion for fitting a cleaning liquid supplying cleaning cartridge replaceably. Moreover, change means may be provided for feeding the cleaning liquid of the cleaning cartridge fitted in the insertion portion, in place of the ink of the ink supplying cartridge fitted in said cartridge extension, to the ink supply port either through the ink flow channel in the case of the ink supply mechanism and through the ink flow channel and the dummy cartridge fitted in the ink supply port in the case of the second ink supply mechanism.

In case the ink jet printer is left unused for a long time or at the time of transporting the ink jet printer, the cleaning cartridge can be fitted in the insertion portion of the cleaning cartridge belonging to the cartridge extension. By using the change means, moreover, the cleaning liquid of the cleaning cartridge can be fed, in place of the ink of the ink supplying cartridge fitted in the cartridge extension, to the ink supply port of the printer body through the ink flow channel in the case of the first ink supply mechanism and through the ink flow channel and the dummy cartridge fitted in the ink supply port in the case of the second ink supply mechanism. The cleaning liquid can be circulated in the ink flow channel, the dummy cartridge and the nozzles arranged on the ink jet head so that it can be discharged into its receiving pan disposed below the nozzles. The ink, which might otherwise be left in the ink flow channel, the dummy cartridge or the nozzles, can be washed away with the cleaning liquid and can be discharged from the insides of the ink flow channel, the dummy cartridge and the nozzles. While the ink jet printer is not used for a long time or when the ink jet printer is transported, the ink, which might otherwise be left in the ink flow channel, the dummy cartridge and the diametrically small nozzles, can be prevented from being solidified to clog the ink flow channel, the dummy cartridge or the nozzles.

When the cleaning liquid in the cleaning cartridge is used up completely the cleaning cartridge can be pulled out from the insertion portion of the cartridge extension and replaced by another new cleaning cartridge filled up with the cleaning liquid. Moreover, the cleaning liquid of the new cleaning cartridge can likewise be circulated in the ink flow channel, the dummy cartridge and the nozzles arranged on the ink jet head by means of the change means and may be discharged into the pan disposed below the nozzles. Moreover, the ink left in the ink flow channel, the dummy cartridge and the nozzles can be continuously washed away with the cleaning liquid.

This washing of the insides of the ink passage, the dummy cartridge and the nozzles with the cleaning liquid of the cleaning cartridge is especially effective in case the ink jet head is supplied with the ink using such an organic solvent as will evaporate and solidify more easily than the general aqueous ink.

BEST MODE FOR CARRYING OUT THE INVENTION

The best mode for carrying out of the invention will be described with reference to the accompanying drawings.

Figure 1:
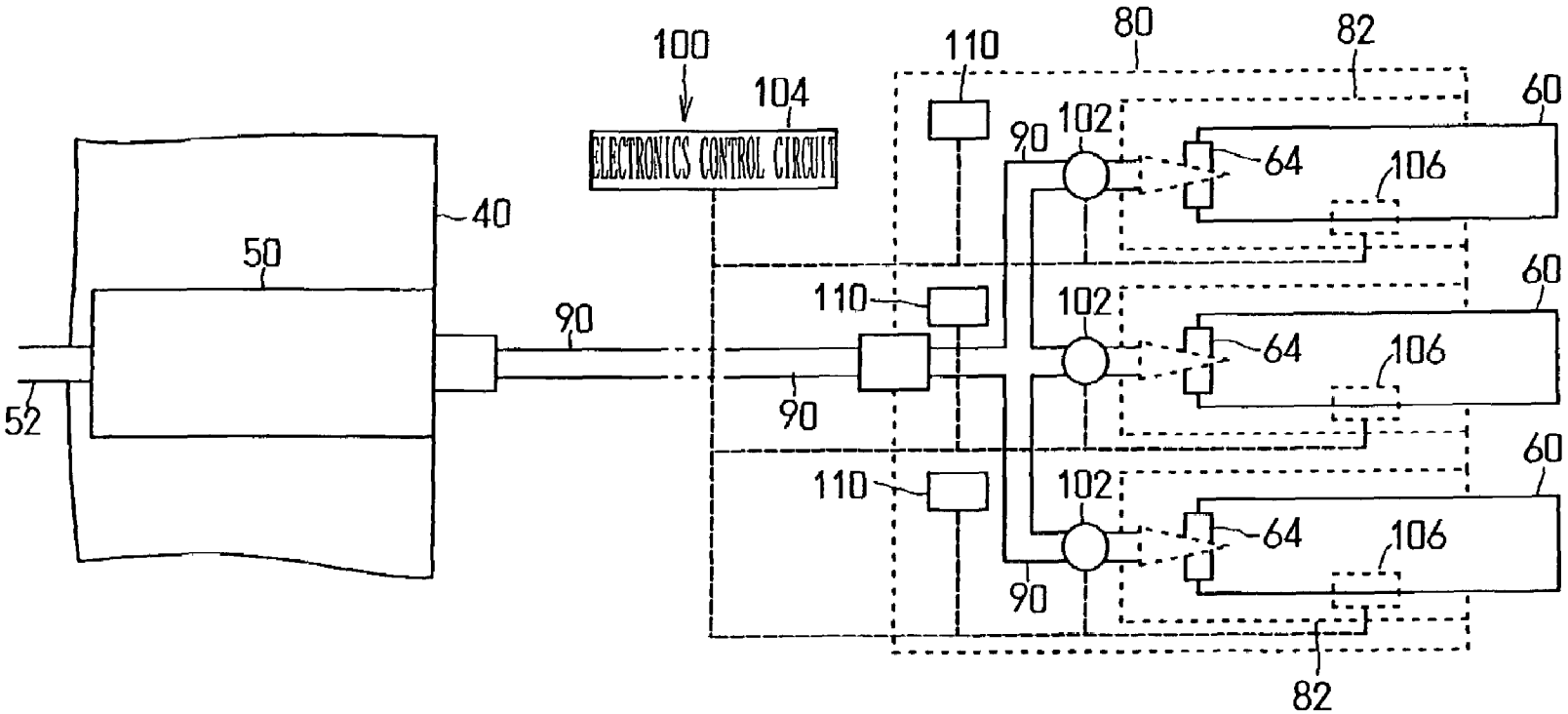
FIG. 1 is a schematic configuration explaining diagram of an ink jet printer equipped with a first ink supply mechanism of the invention.

FIG. 1 shows a preferred embodiment of a first ink supply mechanism of the invention.

Figure 5:
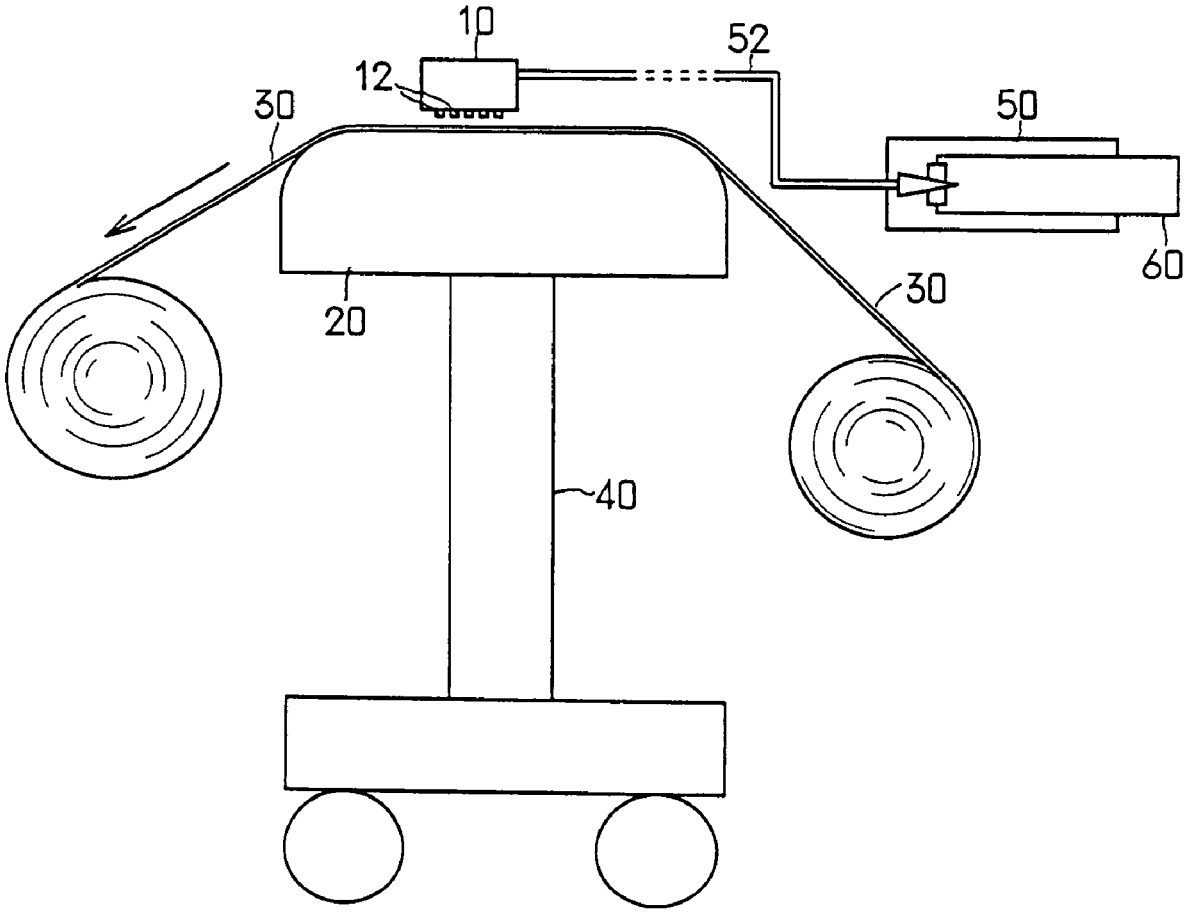
FIG. 5 is a schematic configuration explaining diagram of an ink jet printer.

This first ink supply mechanism is employed in an ink jet printer, in which a printer body 40 is equipped with an ink supply port 50 for supplying ink, as shown in the foregoing FIG. 5. The ink supply port 50 is connected to an ink jet head 10 through a flexible long resin tube 52 or the like so that the ink supplied to the ink supply port 50 is fed to the ink jet head 10 through the inside of the resin tube 52 or the like.

This first ink supply mechanism is equipped, as shown in FIG. 1, with a cartridge extension 80 having a plurality of slots 82, in which a plurality of ink supplying cartridges 60 are replaceably fitted.

The cartridge 60 is so configured, for example, that a soft pack of aluminum confining the ink is housed in a hard plastic container having an insertion port 64 to be replaceably fitted in the slot 82.

The cartridge extension 80 and the ink supply port 50 of the printer body are connected to each other through an ink flow channel 90 made of a plurality of resin tubes, as shown in FIG. 1. Moreover, the ink of the cartridge 60 inserted into each of the slots 82 of the cartridge extension is supplied through the ink flow channel 90 to the ink supply port 50 of the printer body.

Moreover, the ink is continuously supplied from one of the cartridges 60 individually fitted in the slots 82 of the cartridge extension, to the ink supply port 50 of the printer body through the ink flow channel 90 until the residual of the ink in the one cartridge 60 comes to zero or near. When this depletion is detected, the ink in the next cartridge 60 fitted in any of the slots 82 of the cartridge extension is continuously supplied to the ink supply port 50 of the printer body through the ink flow channel 90. This step is repetitively performed by electronic control type sequence control means 100 consecutively for the individual cartridges 60 fitted in the cartridge extension 80.

This sequence control means 100 is configured, as shown in FIG. 1, to include: solenoid valves 102 disposed at individual portions of the ink flow channel 90; an electronic control circuit 104 for opening/closing the valves automatically; and detectors 106 for detecting the depletions of ink contents in the individual cartridges 60 fitted in the slots 82 of the cartridge extension. The sequence control means 100 is configured to feed the ink contents of the individual cartridges 60 fitted in the slots 82 of the cartridge extension, while applying a pressure within a desired range, into nozzles 12 of the ink jet head through the ink flow channel 90 by utilizing the head difference between the ink levels in the cartridges 60 and the ink levels in the nozzles 12 of the ink jet head.

The first ink supply mechanism shown in FIG. 1 has the configuration thus far described.

Figure 2:
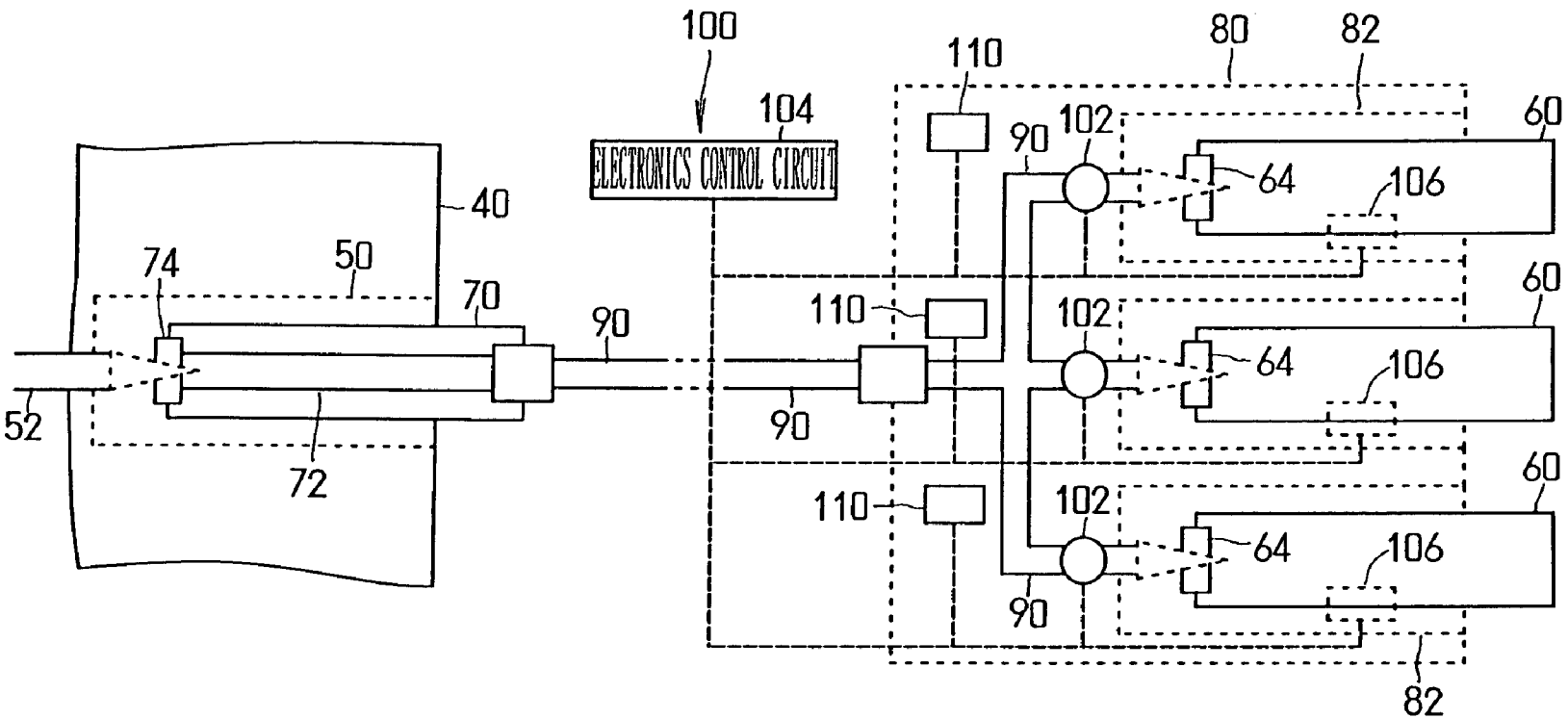
FIG. 2 is a schematic configuration explaining diagram of an ink jet printer equipped with a second ink supply mechanism of the invention.

FIG. 2 shows a preferred embodiment of the second ink supply mechanism of the invention.

This second ink supply mechanism is employed in the ink jet printer equipped in its body 40 with the ink supply port 50, into which the ink supplying cartridges 60 are replaceably fitted, as shown in FIG. 5. The ink supply port 50 is connected to the ink jet head 10 through the flexible long resin tube 52 or the like so that the ink supplied to the ink supply port 50 is fed into the ink jet head 10 through the inside of the resin tube 52 or the like. The cartridge 60 to be replaceably fitted in the ink supply port 50 is so generally configured that a soft pack of aluminum confining the ink is housed in a hard plastic container having an insertion portion to be replaceably fitted in the ink supply port 50.

This second ink supply mechanism is equipped, as shown in FIG. 2, with a dummy cartridge 70 to be fitted replaceably with the ink supplying general-purpose cartridges 60 in the ink supply port 50 of the printer body, and the cartridge extension 80 having the plurality of slots 82, in which the ink supplying cartridges 60 are replaceably fitted.

The cartridge 60 to be replaceably fitted in the cartridge extension 80 is given such a configuration like that of the general-purpose cartridge 60 to be fitted in the ink supply port 50, for example, that a soft pack of aluminum confining the ink is housed in a hard plastic container having the insertion portion 64 to be replaceably fitted in the aforementioned slot 82.

In the dummy cartridge 70, insertion portion 74 to be fitted in the ink supply port 50 is formed to have a contour and a size identical to those of the insertion portion of the general-purpose cartridge 60 to be fitted in the ink supply port 50. Moreover, the dummy cartridge 70 is so configured as can be replaceably fitted in the ink supply port 50 of the printer body 40, in which the general-purpose cartridge 60 is fitted. The dummy cartridge 70 is simply configured to have an ink passage 72 therein, as shown in FIG. 2.

The dummy cartridge 70 and the cartridge extension 80 are connected to each other, as shown in FIG. 2, through the ink flow channel 90 for supplying the ink of the cartridge 60 fitted in each of the slots 82 of the cartridge extension, to the ink supply port 50 of the printer body having that dummy cartridge fitted therein, through the ink passage 72 inside of the dummy cartridge. The ink flow channel 90 is formed by connecting a plurality of resin tubes or the like.

Moreover, the ink is continuously supplied from one of the cartridges 60 individually fitted in the slots 82 of the cartridge extension, to the ink supply port 50 of the printer body through the ink flow channel 90 and the ink passage 72 of the dummy cartridge fitted in the ink supply port 50 until the residual of the ink in the one cartridge 60 comes to zero or near. When this depletion is detected, the ink in the next cartridge 60 fitted in any of the slots 82 of the cartridge extension is continuously supplied to the ink supply port 50 of the printer body through the ink flow channel 90 and the ink passage 72 inside of the dummy cartridge. This step is repetitively performed by electronic control type sequence control means 100 consecutively for the individual cartridges 60 fitted in the cartridge extension 80. This sequence control means 100 is configured, as shown in FIG. 2, to include: solenoid valves 102 disposed at individual portions of the ink flow channel 90; an electronic control circuit 104 for opening/closing the valves automatically; and detectors 106 for detecting the depletions of ink contents in the individual cartridges 60 fitted in the slots 82 of the cartridge extension. The sequence control means 100 is configured to feed the ink contained in the individual cartridges 60 fitted in the slots 82 of the cartridge extension, while applying a pressure within a desired range, into nozzles 12 of the ink jet head through the ink flow channel 90, the ink passage 72 inside of the dummy cartridge fitted in the ink supply port 50 and the ink supply port 50, by utilizing the head difference between the ink levels in the cartridges 60 and the ink levels in the nozzles 12 of the ink jet head.

The second ink supply mechanism shown in FIG. 2 has the configuration thus far described.

Here will be described the examples of using those first and second ink supply mechanisms and their actions.

When the first ink supply mechanism is employed, the sequence control means 100 is used to supply the ink continuously from any one of the cartridges 60 individually fitted in the slots 82 of the cartridge extension, to the ink supply port 50 of the printer body through the ink flow channel 90 made of the resin tube and the like.

When the second ink supply mechanism is employed, on the other hand, the dummy cartridge 70 is fitted in place of the ink supplying general-purpose cartridge 60 in the ink supply port 50 of the printer body, as shown in FIG. 2. By using the sequence control means 100, moreover, the ink from any of the cartridges 60 individually fitted in the slots 82 of the cartridge extension is continuously supplied to the ink supply port 50 of the printer body through the ink flow channel 90 made of the resin tube or the like and the ink passage 72 inside of the dummy cartridge fitted in the ink supply port 50.

At an unmanned night while the ink jet printer equipped with that first or second ink supply mechanism is being employed, the ink is then continuously supplied from one of the cartridges 60 individually fitted in the slots 82 of the cartridge extension, to the ink supply port 50 until the residual of the ink in the one cartridge 60 comes to zero or near. This depletion of ink in one cartridge 60 supplying the ink can be detected by the sequence control means 100. The ink in the next new cartridge 60, in place of the cartridge 60, fitted in any of the slots 82 of the same cartridge extension is continuously supplied to the ink supply port 50 through the ink flow channel 90 in the case of the first ink supply mechanism and through the ink flow channel 90 and the ink passage 72 inside of the dummy cartridge fitted in the ink supply port 50 in the case of the second ink supply mechanism. This step can be automatically performed by the electronic control type sequence control means 100.

For the individual cartridges 60 fitted in the slots 82 of the cartridge extension, the same step as the aforementioned one can be repeated automatically and repetitively by using the sequence control means 100. As a result, it is possible to avoid the situations, in which the ink depletion of the cartridge 60 might occur at an unmanned night while the ink jet printer is being employed, causing to stop or idly run the ink jet printer.

Moreover, the cartridge 60 fitted in any of the slots 82 of the cartridge extension and depleted of ink can be replaced by another new cartridge 60 filled with sufficient ink, in the state not interrupting but continuing the printing operation by the ink jet printer, while the ink supply port 50 is being supplied with the ink of the other cartridge 60 fitted in any of the slots 82 of the same cartridge extension. When another chance for supplying the ink of the new cartridge 60 to the ink supply port 50 comes, the sequence control means 100 can be used like before to supply the ink of the new cartridge 60 continuously to the ink supply port 50 through the ink flow channel 90 in the case of the first ink supply mechanism and through the ink flow channel 90 and the ink passage 72 inside of the dummy cartridge fitted in the ink supply port 50 in the case of the second ink supply mechanism.

On either the individual cartridges 60 fitted in the slots 82 of the cartridge extension or any of the new cartridge 60 of the slots 82 of the cartridge extension, the same step as the aforementioned one can be repeated automatically and sequentially by using the sequence control means 100. Moreover, the ink supply port 50 of the printer body being continuously employed can be supplied with the ink continuously without any depletion for a long time.

Moreover, these first and second ink supply mechanisms are configured, as described above, such that the sequence control means 100 detects that the ink of one of the cartridges 60 individually fitted in the slots 82 of the cartridge extension is depleted. After the ink being supplied from one of the cartridges 60 was exploited without any waste, in place of the cartridge 60 depleted of the ink, the ink of the new cartridge 60 fitted in any of the slots 82 of the cartridge extension is continuously supplied by the sequence control means 100 to the ink supply port 50 of the printer body through the ink flow channel 90 in the case of the first ink supply mechanism and through the ink flow channel 90 and the ink passage 72 inside of the dummy cartridge fitted in the ink supply port 50 in the case of the second ink supply mechanism.

Therefore, the ink contained in the cartridges 60 individually fitted in the slots 82 of the cartridge extension can be sequentially used up completely. Moreover, the individual cartridges 60 fitted in the slots 82 of the cartridge extension can be prevented from being wastefully discarded with the ink being not used up completely but left in a considerable amount.

In these first and second ink supply mechanisms, as shown in FIG. 1 and FIG. 2, the detector 106 or the like of the sequence control means may be equipped with warning means 110 for notifying the printer user of the depletion of the ink of the cartridge 60, when the detector 106 of the sequence control means detects that the cartridge 60 fitted in the cartridge extension 80 and supplying the ink is depleted of the ink to be supplied. The warning means 110 may be configured to notify the printer user with a light or sound or vibrations and can be exemplified by a warning light lamp or a warning sound buzzer.

Moreover, the warning means 110 may be able to notify it reliably with no error that the cartridge 60 fitted in the cartridge extension 80 and supplying the ink is depleted of the ink. Then, the printer user may replace the depleted cartridge 60 by another new cartridge 60 filled sufficiently with the ink, and may fit the new cartridge 60 without delay in the slot 82 of the cartridge extension.

Figure 3:
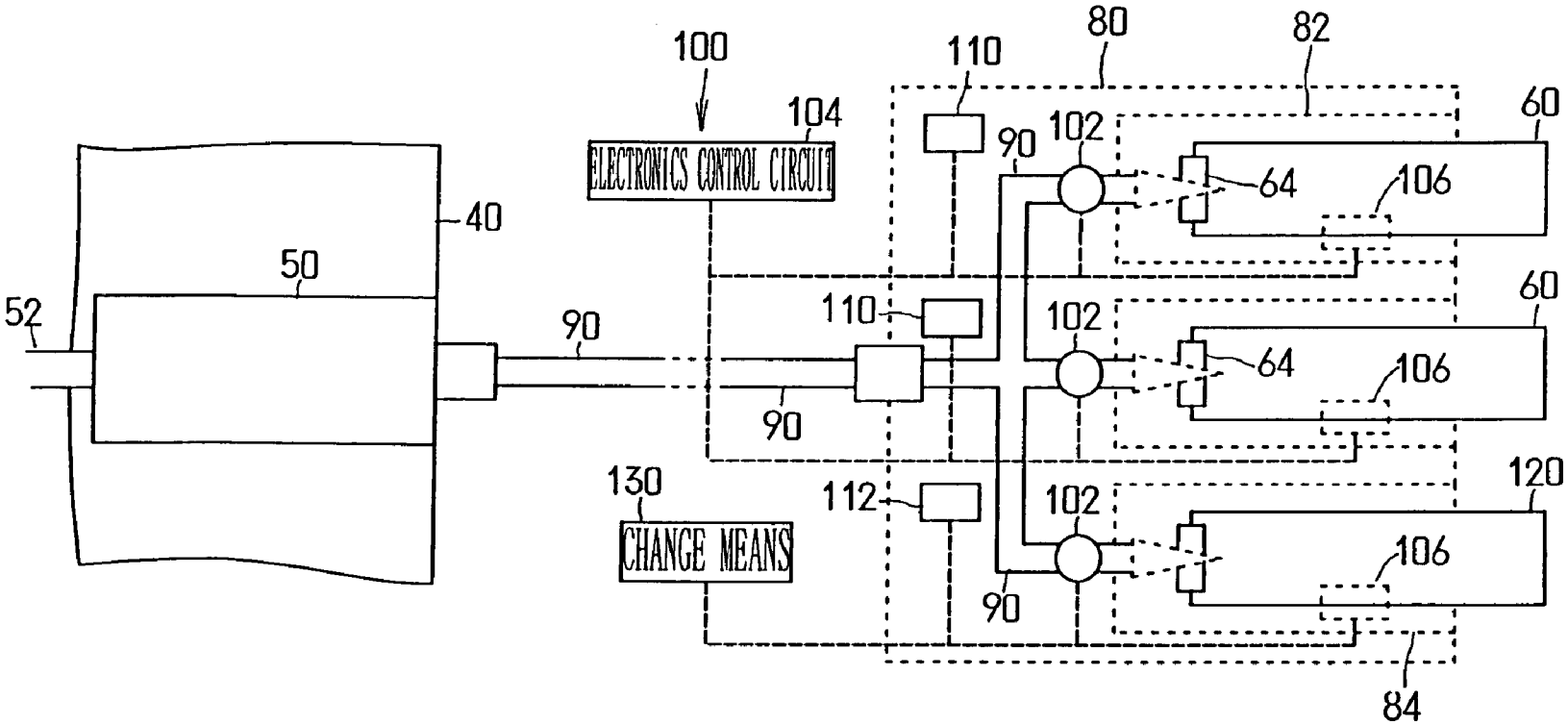
FIG. 3 is a schematic configuration explaining diagram of another ink jet printer equipped with the first ink supply mechanism of the invention.
Figure 4:
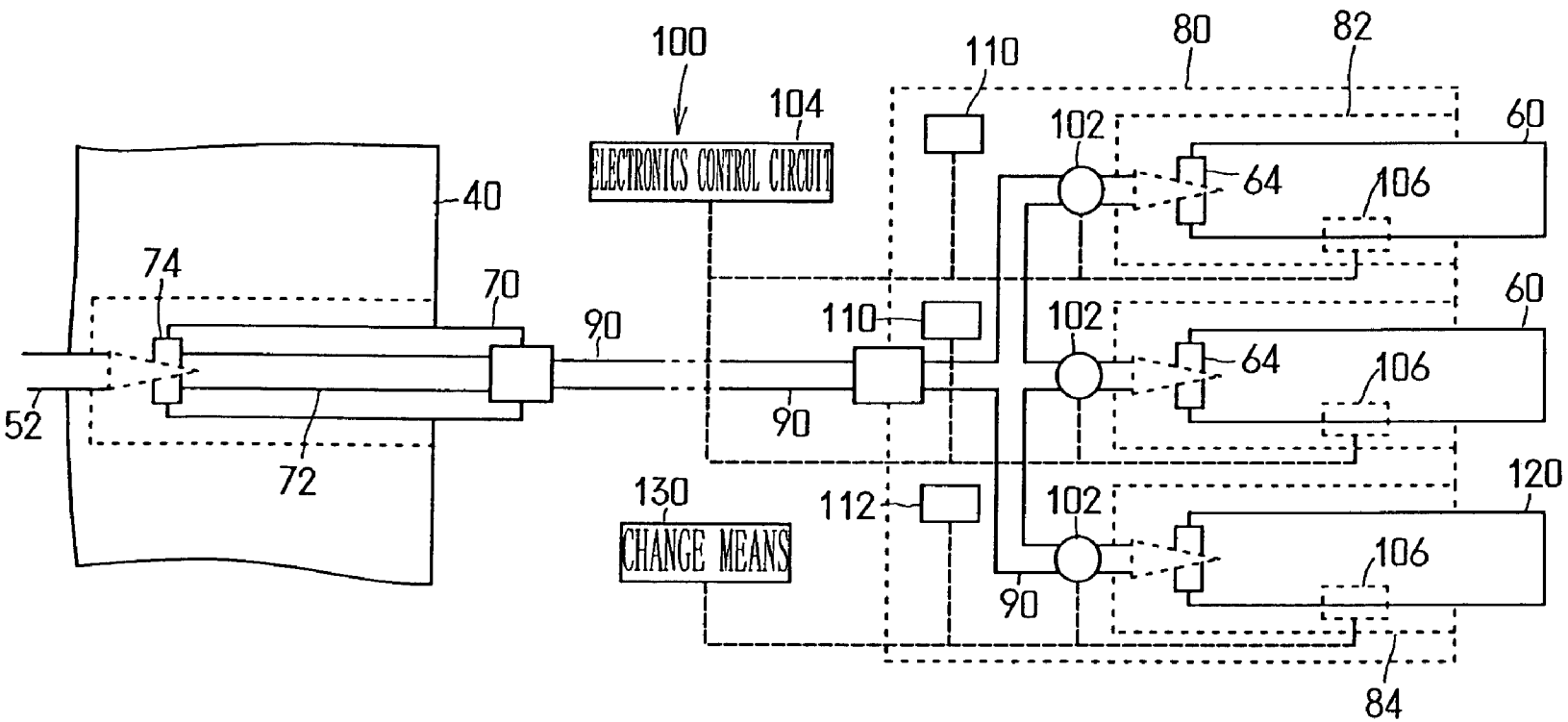
FIG. 4 is a schematic configuration explaining diagram of another ink jet printer equipped with the second ink supply mechanism of the invention.

In these first and second ink supply mechanisms, the cartridge extension 80 may be equipped, as shown in FIG. 3 and FIG. 4, with an insertion portion 84 for replaceably fitting a cleaning cartridge 120 for supplying a cleaning liquid. There may also be provided with an electronic control type or manual operation type change means 130 for supplying the cleaning liquid of the cleaning cartridge 120 fitted in that insertion portion 84, in place of the ink of the ink supplying cartridge 60 fitted in the slot 82 of the same cartridge extension, to the ink supply port 50 of the printer body through the ink flow channel 90 in the case of the first ink supply mechanism and through the ink flow channel 90 and the ink passage 72 inside of the dummy cartridge fitted in the ink supply port 50 in the case of the second ink supply mechanism. The change means 130 may be configured by using the solenoid valve 102 or the electronic control circuit 104 of the aforementioned sequence control means, an electronic circuit packaged in a host computer for driving the printer, or an electronic circuit packaged in the printer body. The change means 130 may be configured to feed the cleaning liquid of the cleaning cartridge 120 fitted in the insertion portion 84 of the cartridge extension, through the ink flow channel 90 in the case of the first ink supply mechanism and through the ink flow channel 90 and the ink passage 72 of the dummy cartridge fitted in the ink supply port 50 in the case of the second ink supply mechanism, while applying a pressure within a desired range from the ink supply port 50 to the inside of the nozzles 12 of the ink jet head, by utilizing the head difference between the cleaning liquid levels in the cleaning cartridge 120 and the cleaning liquid levels in the nozzles 12 of the ink jet head. The cleaning cartridge 120 may be formed, for example, to have a configuration and a size identical to those of the ink supplying cartridge 60 containing the cleaning liquid in place of the ink.

When the ink jet printer is left unused for a long time or when the ink jet printer is transported, the insertion portion 84 of the cartridge extension may have the cleaning cartridge 120 fitted therein. Moreover, the cleaning liquid of the cleaning cartridge 120 fitted in the insertion portion 84 may be fed, in place of the ink of the ink supplying cartridge 60 fitted in the slot 82 of the same cartridge extension, to the ink supply port 50 of the printer body through the ink flow channel 90 in the case of the first ink supply mechanism and through the ink flow channel 90 and the ink passage 72 inside of the dummy cartridge fitted in the ink supply port 50, by means of the change means 130. The cleaning liquid may be circulated in the nozzles 12 arranged on the ink jet head so that it may be ejected into the (not-shown) cleaning liquid pan disposed below the nozzles 12. Moreover, the ink, which might otherwise reside in the ink flow channel 90, the ink passage 72 of the dummy cartridge and the nozzles 12, may be washed away with the cleaning liquid and cleared away from the inside of the ink passage 72 of the dummy cartridge or from the inside of the nozzles 12. While the ink jet printer is not used for a long time or when the ink jet printer is transported, moreover, the ink, which might otherwise be left in the ink flow channel 90, the ink passage 72 of the dummy cartridge and the diametrically small nozzles 12, may be prevented from being solidified to clog the ink flow channel 90, the ink passage 72 of the dummy cartridge or the nozzles 12.

When the cleaning liquid in the cleaning cartridge 120 is used up completely the cleaning cartridge 120 may be pulled out from the insertion portion 84 of the cartridge extension and replaced by another new cleaning cartridge 120 filled up with the cleaning liquid. The cleaning liquid of the new cleaning cartridge 120 may likewise be circulated in the ink flow channel 90, the ink passage 72 inside of the dummy cartridge and the nozzles 12 arranged on the ink jet head by means of the change means 130 and may be discharged into the its pan disposed below the nozzles 12. The ink left in the ink flow channel 90, the ink passage 72 of the dummy cartridge and the nozzles 12 may be continuously and sufficiently washed away with the cleaning liquid.

In the first or second ink supply mechanism equipped with the insertion portion 84 of the cleaning cartridge 120 and the change means 130, there may be provided warning means 112 such as a lamp or buzzer for notifying the printer user of the depletion of the cleaning liquid of the cleaning cartridge 120, when it is detected by the detector 106 or the like that the residue of the cleaning liquid of the cleaning cartridge 120 fitted in the insertion portion 84 of the cartridge extension is depleted, as shown in FIG. 3 and FIG. 4.

Moreover, the warning means 112 may be able to notify the user reliably without any oversight that the cleaning liquid of the cleaning cartridge 120 fitted in the insertion portion 84 of the cartridge extension has been depleted. Then, the printer user may be able to replace the cleaning cartridge 120 having its cleaning liquid used up completely, by another new cleaning cartridge 120 filled up with the cleaning liquid, and to fit the new cleaning cartridge 120 in the insertion portion 84 of the cartridge extension without delay.

In this first or second ink supply mechanism, the ink supplying cartridge 60 to be fitted in the slot 82 of the cartridge extension or the cleaning cartridge 120 to be fitted in the insertion portion 84 of the cartridge extension may have the same configuration and size as those of the general-purpose cartridge 60 to be fitted in the ink supply port 50 of the printer body, but can have a configuration and a size different from those of the general-purpose cartridge 60.

In the second ink supply mechanism, on the other hand, the dummy cartridge 70 to be used may be contoured to have the same shape and size as those of the general-purpose cartridge 60, but can have a shape and a size different from those of the general-purpose cartridge 60.

In case the dummy cartridge 70 used in the second ink supply mechanism is contoured to have the same shape and size as those of the general-purpose cartridge 60, the dummy cartridge 70 can be so fitted in the ink supply port 50 of the printer body as can be replaced by the ink supplying general-purpose cartridge 60. Moreover, the second ink supply mechanism of the invention can be optically employed without any change in the configuration of the printer in the general ink jet printer having the printer body 40 equipped with the ink supply port 50 for fitting the general-purpose cartridge 60 replaceably. In short, the printer can be equipped with the second ink supply mechanism merely by fitting the dummy cartridge 70 in place of the ink supplying general-purpose cartridge 60 in the ink supply port 50 of the printer body.

These first and second ink supply mechanisms can be applied to printers using various kinds of ink such as aqueous pigment ink, aqueous dye ink, solvent ink, oil ink or UV ink (i.e., ink to be set with the irradiation of an ultraviolet ray).

Moreover, these first and second ink supply mechanisms can be provided for ink of different colors such as Yellow, Magenta, Cyan or Black to be supplied to the ink jet head 10.

By these individual ink supply mechanisms, the ink of different colors of Yellow, Magenta, Cyan and Black can be supplied continuously without any interruption to the ink jet head 10 for a long time.

By this first or second ink supply mechanism, the ink of one color such as Yellow, Magenta, Cyan or Black can naturally be supplied continuously without any interruption to the ink jet head 10 for a long time.

INDUSTRIAL APPLICABILITY

The first and second ink supply mechanisms of the invention can be widely utilized in the ink jet printer of the configuration, in which the printer body is equipped with the ink supply port so that the ink is supplied from the ink supply port to the ink jet head.

On the other hand, the second ink supply mechanism of the invention can be optionally utilized, without any change in the printer configuration, in the ink jet printer of the type, in which the printer body is equipped with the ink supply port to fit the ink supplying cartridge replaceably therein so that the ink is supplied from the ink supply port to the ink jet head.

The invention claimed is:

1. In an ink jet printer having a printer body equipped with an ink supply port for supplying ink to an ink jet head, an ink supply mechanism for the ink jet printer comprising:

a cartridge extension having a plurality of ink supplying cartridges replaceably fitted therein, said cartridge extension and said ink supply port being connected to each other through a common ink flow channel for supplying the ink supply port with the ink of each of the cartridges fitted in the cartridge extension;

a sequence control means for repeating such a step sequentially for the individual cartridges fitted in the cartridge extension as supplies the ink continuously from any of the cartridges fitted in said cartridge extension to said ink supply port through said ink flow channel, and as detects that the ink in one cartridge is depleted, and as supplies the ink in the next cartridge fitted in said cartridge extension continuously to the ink supply port through said ink flow channel; and a warning means for notifying a printer user that the ink in the cartridge fitted in the cartridge extension and supplying the ink is depleted, when said sequence control means detects the depletion of the ink, wherein said warning means notifies the printer user with sound or vibration means.

2. In an ink jet printer having a printer body equipped with an ink supply port for supplying ink to an ink jet head so that the ink of a cartridge replaceably fitted in said ink supply port is supplied from the ink supply port to the ink jet head, an ink supply mechanism for the ink jet printer comprising:

a dummy cartridge to be fitted in said ink supply port replaceably with said cartridge and a cartridge extension having a plurality of ink supplying cartridges replaceably fitted therein;

said dummy cartridge and said cartridge extension being connected to each other through a common ink flow channel for supplying the ink of each cartridges fitted in the cartridge extension to the ink supply port having said dummy cartridge fitted therein through said dummy cartridge; and a sequence control means for repeating such a step sequentially for the individual cartridges fitted in the cartridge extension as supplies the ink continuously from any of the cartridges fitted in said cartridge extension to said ink supply port through said ink flow channel and through the dummy cartridge fitted in the ink supply port, and as detects that the ink in one cartridge is depleted, and as supplies the ink in the next cartridge fitted in said cartridge extension continuously to the ink supply port through said ink flow channel and through the dummy cartridge fitted in said ink supply port, wherein said dummy cartridge includes an ink passage extending therethrough from a first end thereof connected to said common ink flow channel to a second end thereof configured to be connected to the ink supply port that is connected to the ink jet head.

3. An ink supply mechanism for an ink jet printer as set forth in claim 2, further comprising a warning means for notifying a printer user that the ink in the cartridge fitted in the cartridge extension and supplying the ink is depleted, when said sequence control means detects the depletion of the ink.

4. An ink supply mechanism for an ink jet printer as set forth in claim 3, wherein said warning means notifies the printer user with sound or vibration means.

5. In an ink jet printer having a printer body equipped with an ink supply port for supplying ink to an ink jet head, an ink supply mechanism for the ink jet printer comprising:

a cartridge extension having a plurality of ink supplying cartridges replaceably fitted therein, said cartridge extension and said ink supply port being connected to each other through an ink flow channel for supplying the ink supply port with the ink of each of the cartridges fitted in the cartridge extension; and sequence control means for repeating such a step sequentially for the individual cartridges fitted in the cartridge extension as supplies the ink continuously from any of the cartridges fitted in said cartridge extension to said ink supply port through said ink flow channel, and as detects that the ink in one cartridge is depleted, and as supplies the ink in the next cartridge fitted in said cartridge extension continuously to the ink supply port through said ink flow channel, wherein said cartridge extension is equipped with an insertion portion for fitting a cleaning liquid supplying cleaning cartridge replaceably; and further comprising a change means for feeding the cleaning liquid of the cleaning cartridge fitted in said insertion portion, in place of the ink of the ink supplying cartridge fitted in said cartridge extension, to the ink supply port through said ink flow channel.

6. An ink supply mechanism for an ink jet printer as set forth in claim 5, further comprising a dummy cartridge to be fitted in said ink supply port replaceably with said cartridge, wherein said dummy cartridge and said cartridge extension being connected to each other through said ink flow channel for supplying the ink of each cartridges fitted in the cartridge extension to the ink supply port having said dummy cartridge fitted therein through said dummy cartridge.

7. An ink supply mechanism for an ink jet printer as set forth in claim 6, further comprising a warning means for notifying a printer user that the ink in the cartridge fitted in the cartridge extension and supplying the ink is depleted, when said sequence control means detects the depletion of the ink.

8. An ink supply mechanism for an ink jet printer as set forth in claim 7, wherein said warning means notifies the printer user with light, sound or vibration means.

9. An ink supply mechanism for an ink jet printer as set forth in claim 5, further comprising a warning means for notifying a printer user that the ink in the cartridge fitted in the cartridge extension and supplying the ink is depleted, when said sequence control means detects the depletion of the ink.

10. An ink supply mechanism for an ink jet printer as set forth in claim 9, wherein said warning means notifies the printer user with light, sound or vibration means.

11. An ink supply mechanism for an ink jet printer having a printer body equipped with an ink supply port for supplying ink to an ink jet head, said ink supply mechanism comprising:

a cartridge extension being configured to replaceably receive a plurality of ink supplying cartridges therein;

a common ink flow channel configured to be connected to each of the plurality of ink supplying cartridges received within said cartridge extension, said common ink flow channel being configured to carry ink between said cartridge extension and the ink supply port; and a control device configured to sequentially supply ink from each individual ink supplying cartridge of the plurality of ink supplying cartridges to provide a continuous supply of ink from the plurality of ink supplying cartridges received in said cartridge extension to the ink supply port, wherein said cartridge extension is equipped with an insertion portion for fitting a cleaning liquid supplying cleaning cartridge replaceably, and further comprising a change means for feeding the cleaning liquid of the cleaning cartridge fitted in said insertion portion, in place of the ink of the ink supplying cartridge received in said cartridge extension, to the ink supply port through said ink flow channel.

12. The ink supply mechanism as set forth in claim 11, further comprising a dummy cartridge configured to be fitted in the ink supply port, said dummy cartridge being connected to said ink flow channel and configured to carrying ink from the ink supply port to said ink flow channel.

13. The ink supply mechanism as set forth in claim 12, wherein said control device is configured to detect depletion of the ink in one or more cartridges received in said cartridge extension, and further comprising a warning means for notifying a printer user that the ink in the one or more cartridges received in said cartridge extension is depleted when said control device detects the depletion of the ink.

14. The ink supply mechanism as set forth in claim 11, wherein said control device is configured to detect depletion of the ink in one or more cartridges received in said cartridge extension, and further comprising a warning means for notifying a printer user that the ink in the one or more cartridges received in said cartridge extension is depleted when said control device detects the depletion of the ink.

* * * * *